US007080602B2

(12) United States Patent
Kawaguchi et al.

(10) Patent No.: US 7,080,602 B2
(45) Date of Patent: Jul. 25, 2006

(54) CAP FRAME AND CAP-FRAME SETTING FRAME

(75) Inventors: Yasuhiko Kawaguchi, Nagoya (JP); Yasukazu Noguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/080,949

(22) Filed: Mar. 16, 2005

(65) Prior Publication Data

US 2005/0211146 A1 Sep. 29, 2005

(30) Foreign Application Priority Data

Mar. 25, 2004 (JP) ..... 2004-089693

(51) Int. Cl.
*D05C 9/04* (2006.01)

(52) U.S. Cl. ..... 112/103

(58) Field of Classification Search ..... 112/470.14, 112/103, 475.11; 101/127.1; 160/380; 38/102.91
See application file for complete search history.

(56) References Cited

U.S. PATENT DOCUMENTS 4,628,843 A * 12/1986 Tajima ..... 112/103
5,598,797 A * 2/1997 Patterson ..... 112/103
5,649,496 A 7/1997 Morita et al.
5,701,831 A 12/1997 Morita
6,453,833 B1 * 9/2002 Ozeki ..... 112/103
6,463,867 B1 * 10/2002 Kato ..... 112/103
6,775,934 B1 * 8/2004 Gallik et al. ..... 38/102.2

FOREIGN PATENT DOCUMENTS

JP A 11-21757 1/1999
JP A 11-200224 7/1999
JP A 11-200227 7/1999
JP B2 2958946 7/1999

* cited by examiner

*Primary Examiner*—Ismael Izaguirre
(74) *Attorney, Agent, or Firm*—Oliff & Berridge, PLC

(57) ABSTRACT

A cap frame of an embroidery sewing machine includes a ring-shaped cap frame body to be detachably coupled with a moving mechanism of the embroidery sewing machine, a cap supporting segment attached to the cap frame body having a curved frame shape in which the cap is set, a holding-down member for holding down the vicinity of the area to be embroidered of the cap onto the cap supporting segment, and a cap central reference area formed at a circumferential center of a front edge on a cap top side of the cap supporting segment, which is tactually recognizable in touch with it from the outside surface of the cap put on the cap supporting segment. The cap central reference area includes a recess formed by cutting a part of the front edge on the cap top side of the supporting segment.

12 Claims, 17 Drawing Sheets

CAP FRAME AND CAP-FRAME SETTING FRAME

BACKGROUND OF THE INVENTION

1. Field of the Invention

This invention relates to a cap frame for holding a cap in order to do embroidery by an embroidery sewing machine and a cap-frame setting frame used when the cap is attached to or detached from the cap frame.

2. Description of the Related Art

Conventionally, there has been proposed an embroidery sewing machine capable of doing embroidery on a front or left/right side of a cap such as a baseball cap. In such an embroidery sewing machine, with a cap having been previously set in a cap frame, by detachably coupling the cap frame with a moving mechanism of the embroidery sewing machine, the embroidery can be done on the cap. Further, generally, when an operator makes an operation of attaching/detaching the cap for the cap frame, a cap-frame setting frame fixed to an operating stand is used. In this case, after the cap frame has been attached to the cap-frame setting frame, the cap is kept on or taken from the cap frame. For example, JP-A-11-200224 disclosed a concrete configuration of the above cap frame and cap-frame setting frame.

Specifically, the cap frame includes a ring-shaped (thin-cylindrical) cap frame body coupled with the rotating frame of a moving mechanism, a curved cap supporting segment integrally attached to the cap frame body, on which the cap is put, a holding-down member for holding down the vicinity of an area of the cap to be embroidered to the cap supporting segment, and a flange supporting piece coupled with the cap frame body for supporting the flange of the cap. In this case, there are two kinds of the cap supporting segment and holding-down member. In a "non-frame type" of cap frame, the cap supporting segment and holding-down member constantly sandwich both sides of the area of the cap to be embroidered. On the other hand, in a "frame type" of cap frame, the cap supporting segment and holding-down member are formed in a nearly square frame shape to constantly sandwich the portion surrounding the area to be embroidered of the cap to be embroidered.

On the other hand, the cap-frame setting frame has a curved base frame into which the cap frame body of the cap frame is attached in a fit state from outside. The base frame is relatively long in its axial direction. Particularly, where the cap is attached to the "non-frame type" of cap frame, in the state where the cap frame has been attached to the base frame, the base frame projects toward the top of the cap more largely than the cap supporting segment does. And the cap to be set in the cap frame is received from inside at the projecting portion. This facilitates the operation of setting the cap in the cap frame.

Meanwhile, in order to do embroidery at a prescribed position of the cap, it is necessary to set the cap in the cap frame in a circumferentially aligned status. For example, where the embroidery is done on the front of the cap, the positioning of the cap for the cap frame is done by aligning the circumferential center of the cap frame and the center of the front of the cap. Conventionally, in order to make this alignment, a center line was inscribed or marked on the cap frame body. Thus, while an operator makes the alignment so that the center of the cap (mostly, a central seam on the front of the cap) aligns with the center line, he or she does the operation of holding the cap in the cap frame.

However, in the embroidery sewing machine with the center line for alignment inscribed on the cap frame body of the cap frame, once the cap has been put on the cap frame body, the center line is concealed by the cap from view. As a result, the center of the cap frame could not necessarily be easily aligned with the center of the cap. Further, even if the alignment was satisfactory when the cap was put on the cap frame, as the case may be, the cap might slide circumferentially by the holding-down member when the cap was held by the holding-down member.

In order to obviate such an inconvenience, there has been also proposed an embroidery sewing machine in which the center line is inscribed at the tip of the flange supporting piece where the center line is not concealed from view when the cap is put on the cap frame body. However, since the position of the center line is greatly remote from the area to be embroidered, it is not so easy to align the center of the cap frame with the center of the cap by visually checking the center line. Incidentally, as regards the frame type of cap frame having the frame-shaped holding-down member, the center line for alignment can be inscribed on the surface of the holding-down member where the center line is not concealed from view. However, this holding-down member will slide in its circumferential position of the cap frame body (cap supporting segment) owing to changes in the cloth thickness of the cap or in force of holding down the cap by the holding-down member. Thus, the center line for alignment does not teach an exact center position of the cap frame (the central position cannot be known).

SUMMARY OF THE INVENTION

Therefore, an object of this invention is to provide a cap frame and a cap-frame setting frame capable of making alignment easily and surely when a cap is held by a cap frame.

The first cap frame according to this invention includes a ring-shaped cap frame body to be detachably coupled with a moving mechanism of an embroidery sewing machine; a cap supporting segment attached to the cap frame body having a curved frame shape, in which the cap is set in a state put on from the outside; a holding-down member for holding down the vicinity of the area to be embroidered of the cap from the outside onto the cap supporting segment; and a cap central reference area formed at a circumferential center of a front edge on a cap top side of the cap supporting segment, which is tactually recognizable in touch therewith from the outside surface of the cap put on the cap supporting segment, the cap central reference area comprising a recess formed by cutting a part of the front edge on the cap top side of the cap supporting segment.

In setting the cap in the cap frame, an operator puts the cap on the cap supporting segment attached to the cap frame body, and holds down the cap in an aligned state by the holding-down member. In this case, the cap supporting segment is provided with the cap central reference area which is recognizable tactually in touch therewith from the outside surface of the cap. For this reason, in aligning the cap, without visually recognizing the center line, while tactually recognizing the cap central reference area in touch therewith through the cloth of the cap by his/her hand/finger, the operator can easily align the cap by superposing the cap central area on e.g. the center of the cap. In addition, the operation of holding down the cap onto the cap supporting segment by the holding-down member can also be done with the cap being held down onto the cap central reference area by his/her hand/finger. For this reason, the cap can be set while preventing the cap from being misaligned from the cap frame. Accordingly, the alignment in holding the cap by the cap frame can be done easily and surely.

The second cap frame according to this invention includes a ring-shaped cap frame body to be detachably coupled with a moving mechanism of the embroidery sewing machine; a cap supporting segment attached to the cap frame body having a curved frame shape, in which the cap is set in a state put on from the outside; a holding-down member for holding down the vicinity of the area to be embroidered of the cap onto the cap supporting segment from the outside; and at least a pair of cap positioning reference areas formed at positions remote from a circumferential center of a front edge on a cap top side of the cap supporting segment toward both sides thereof by predetermined lengths, which are tactually recognizable in touch therewith from the outside surface of the cap put on the cap supporting segment, each of the cap positioning reference areas comprising a recess formed by cutting a part of the front edge on the cap top side of the cap supporting segment.

In setting the cap in the cap frame, as described above, while tactually recognizing the cap positioning reference areas located symmetrically on both sides of the center of the cap supporting segment in touch therewith through the cloth of the cap by his/her hand/finger, the operator can align the cap. In this case, often, on the front of the cap, seams are formed laterally symmetrically with respect to the center. Thus, the operator can easily align the cap by superposing the respective seams on the cap positioning reference areas. Further, in this case also, by holding down the cap onto the cap positioning reference areas by his/her hand/finger, the operator can do the operation of holding down the cap onto the cap supporting segment by the holding-down member while preventing the cap from being misaligned from the cap frame. Accordingly, the alignment in holding the cap by the cap frame can be done easily and surely.

More concretely, the recess can be formed in a V-shape narrowed from the cap top side toward a cap opening side. By forming the cap central reference area or cap positioning reference area of the recess, its structure can be made relatively simple and also easily tactually recognized. Further, if the cloth of the cap is held down in alignment so that it is caused to enter the recess, the effect of preventing misalignment can be further enhanced.

Otherwise, the cap central reference area or each cap positioning reference area may be formed of a projection or impression. Thus, the cap central reference area or each cap positioning reference area can be made in a simple structure. Incidentally, it can be constructed that in putting on or taking off the cap, the cap frame is detachably attached in a cap-frame setting frame in a state dismantled from an embroidery sewing machine. By using the cap-frame setting frame, the operation of attaching or detaching the cap for the cap frame can be further facilitated.

The first cap-frame setting frame according to this invention is a frame to which a cap frame is detachably attached in putting a cap on or taking off the cap from the cap frame. The cap-frame setting frame includes a curved base frame fixed onto a predetermined working table, at a predetermined position of which the cap frame is attached; and a cap central reference area formed at a circumferential center of an edge on a cap top side of the base frame, which is tactually recognizable in touch therewith from the outside surface of the cap put on the cap frame.

Where an operator sets the cap in the cap frame, first, he or she attaches the cap frame to the base frame of the cap-frame setting frame fixed onto a predetermined working table at a predetermined position thereof, and holds the cap put on the cap frame in this state in an aligned status. In this case, the base frame is provided with the cap central reference area which is recognizable tactually in touch therewith from the outside surface of the cap. For this reason, in aligning the cap with the cap frame, without visually recognizing the center line, while tactually recognizing the cap central reference area in touch therewith through the cloth of the cap by his/her hand/finger, the operator can easily align the cap by superposing the cap central reference area on e.g. the center of the cap. In addition, the operation of holding down the cap onto the cap frame can also be done with the cap being held down onto the cap central reference area by his/her hand/finger. For this reason, the cap can be prevented from being misaligned from the base frame and hence the cap frame. Accordingly, the alignment in holding the cap by the cap frame can be done easily and surely.

The second cap-frame setting frame according to this invention is a frame to which a cap frame is detachably attached in putting a cap on or taking off the cap from the cap frame. This cap-frame setting frame includes a curved base frame fixed onto a predetermined working table, at a predetermined position of which the cap frame is attached; and at least a pair of cap positioning reference areas formed at positions remote from a circumferential center of the edge on the cap top side of the base frame toward both sides thereof by predetermined lengths, which are tactually recognizable in touch therewith from the outside surface of the cap put on the cap frame.

Where an operator sets the cap in the cap frame, first, he or she attaches the cap frame to the curved base frame of the cap-frame setting frame fixed onto a predetermined working table at a predetermined position thereof, and holds the cap put on the cap frame in this state in an aligned status. In this case, as described above, while tactually recognizing the cap positioning reference areas located symmetrically on both sides of the center of the base frame in touch therewith through the cloth of the cap by his/her hand/finger, the operator can align the cap with the cap frame. In this case, mostly, on the front of the cap, seams are formed laterally symmetrically from the center. Thus, the operator can easily align the cap by superposing the respective seams on the cap positioning areas. Further, in this case also, by holding down the cap onto the cap positioning reference areas by his/her hand/finger, the operator can do the operation of holding down the cap onto the cap frame while preventing the cap from being misaligned from the cap frame. Accordingly, the alignment in holding the cap by the cap frame can be done easily and surely.

In each of the cap-frame setting frames, the cap central reference area or each cap positioning reference area can be formed of a recess formed by cutting a part of the edge on the cap top side of the base frame. More concretely, the recess can be formed in a V-shape narrowed from the cap top side toward a cap opening side. By forming the cap central reference area or cap positioning reference area of the recess, its structure can be made relatively simple and also easily tactually recognized. Further, if the cloth of the cap is held down in alignment so that it is caused to enter the recess, the effect of preventing misalignment can be further enhanced.

Otherwise, the cap central reference area or each cap positioning reference area may be formed of a projection or impression. Thus, the cap central reference area or each cap positioning reference area can be made in a simple structure.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
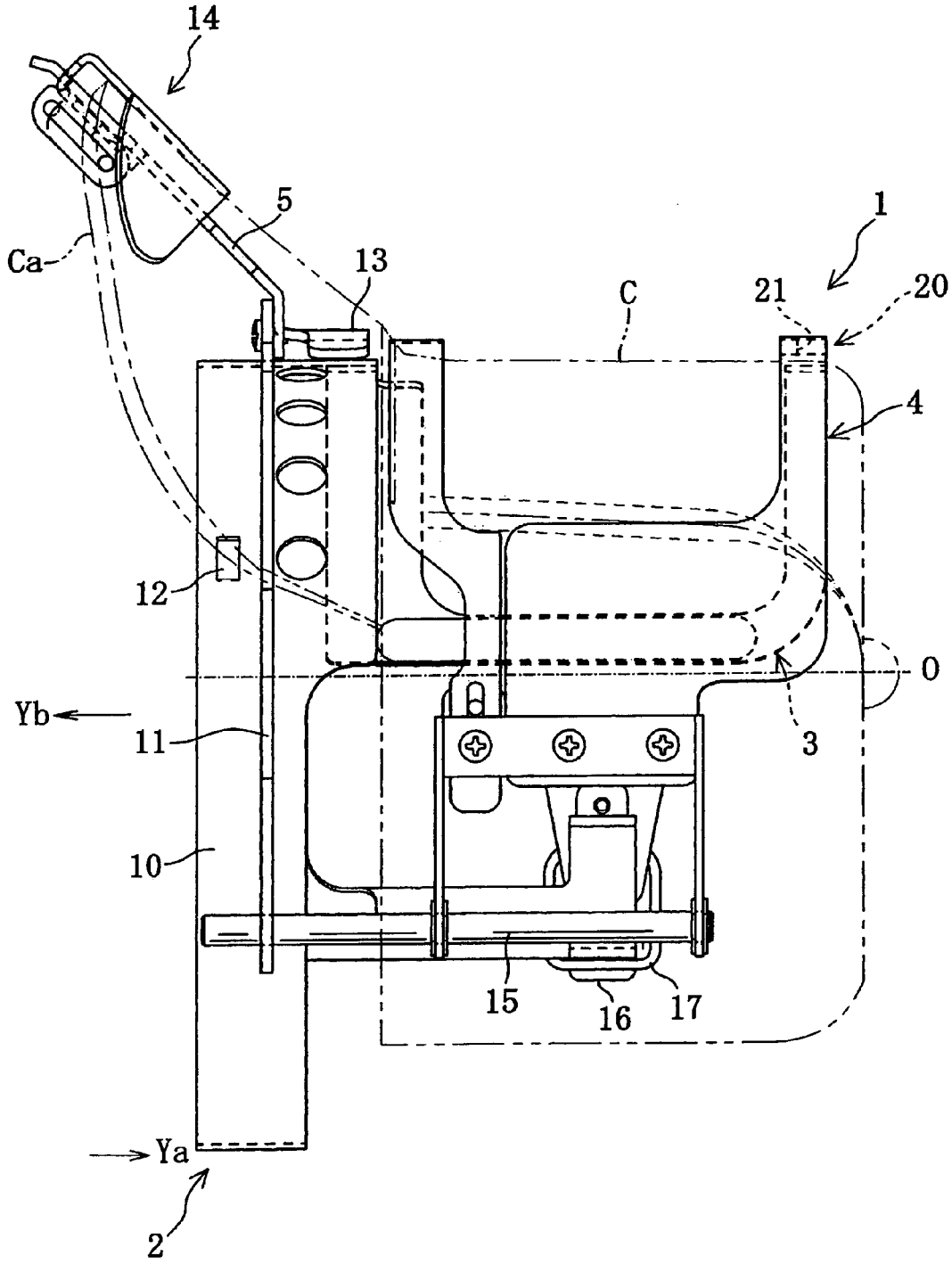
FIG. 1 is a left side view of a cap frame according to a first embodiment of this invention.
Figure 2:
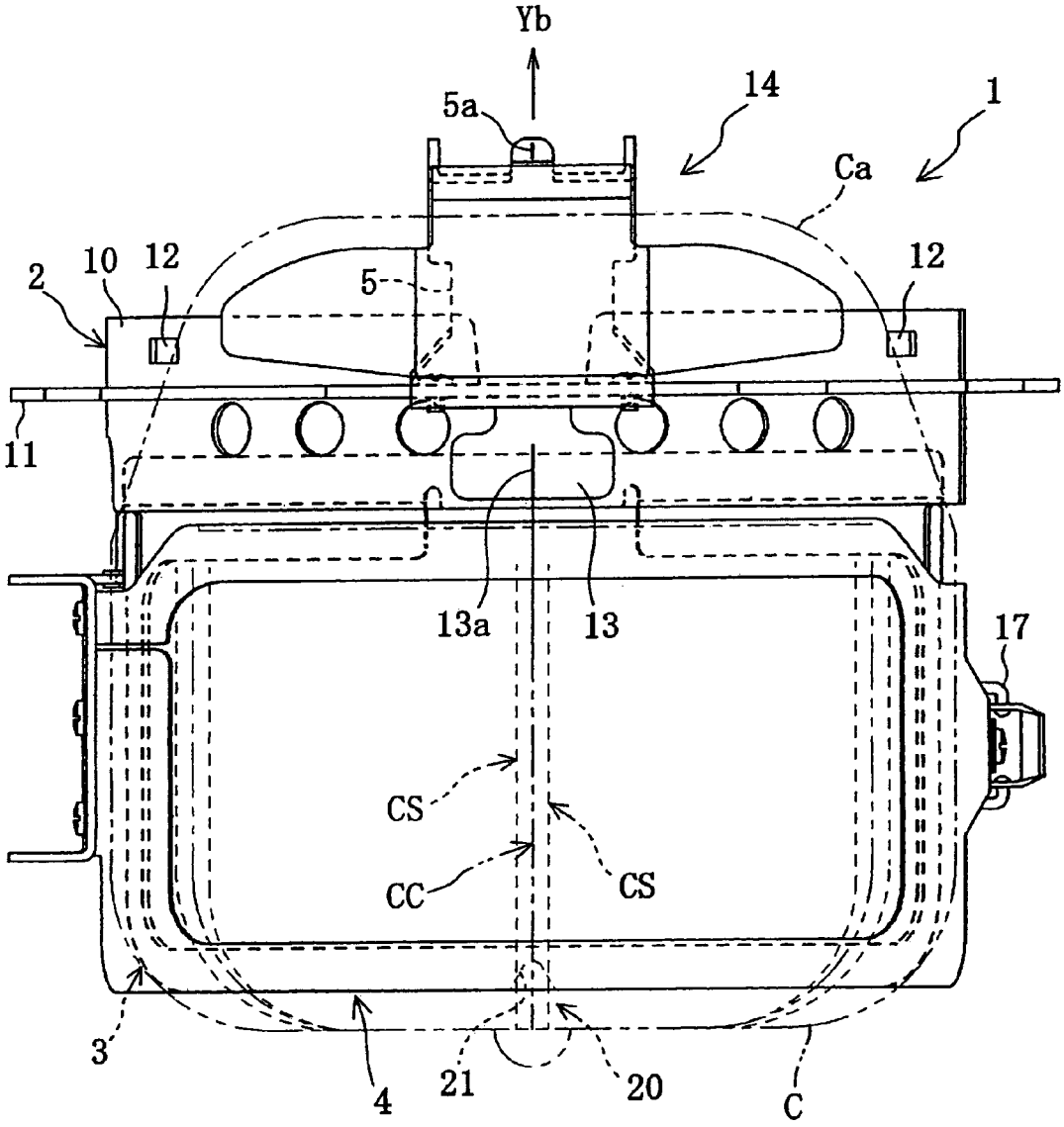
FIG. 2 is a plan view of the cap frame.
Figure 3:
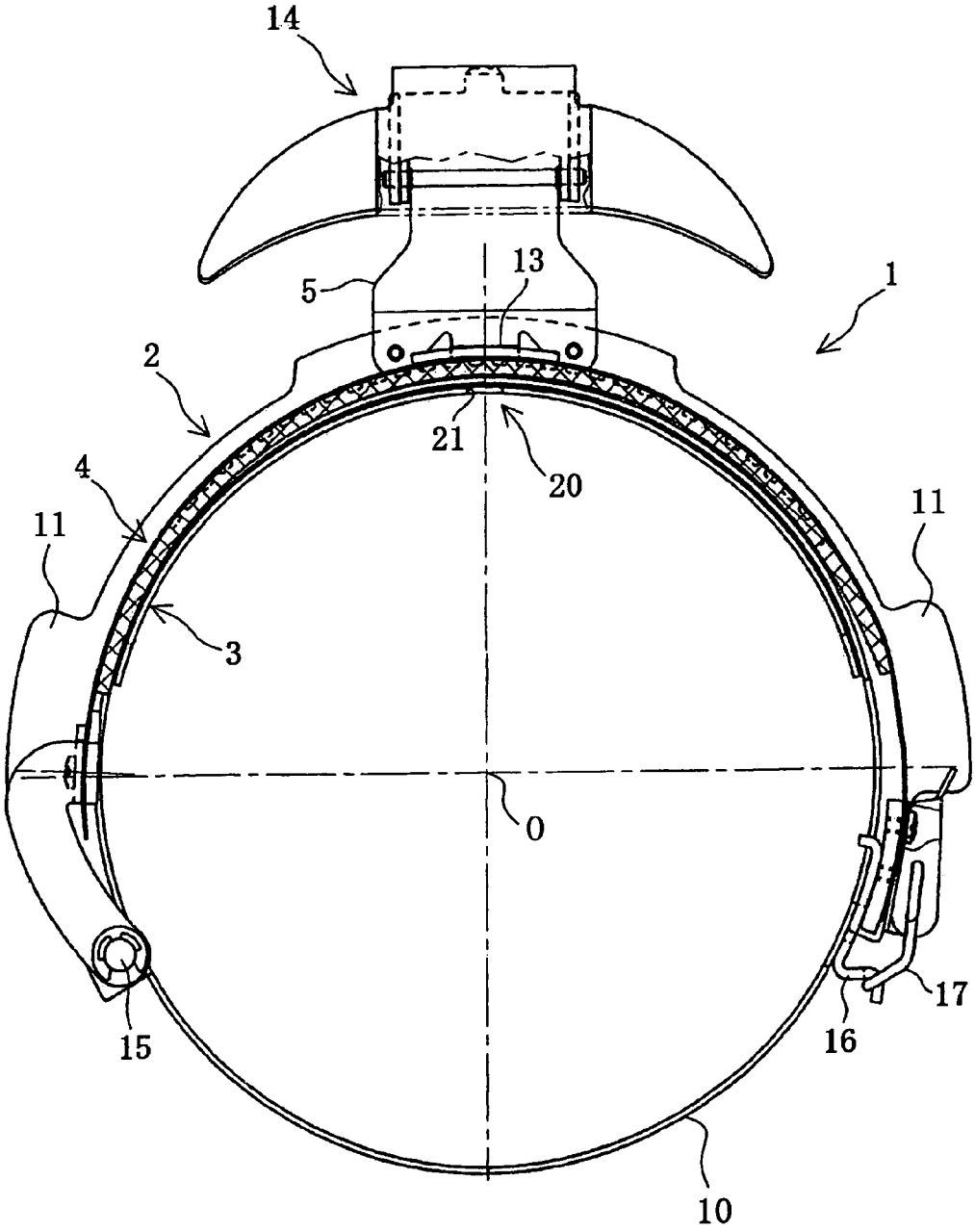
FIG. 3 is a front view of the cap frame.

Now referring to FIGS. 1 to 8, an explanation will be given of a first embodiment of this invention. In this embodiment, this invention is applied to an industrial multi-head embroidery sewing machine capable of simultaneously doing embroidery for plural caps. In this embodiment, it is assumed that the embroidery is done on the front of a baseball cap C. Incidentally, in following explanation, as seen from FIG. 8, it is assumed that the direction in which an operator sits for the multi-head sewing machine is a front direction; the front-rear direction is a Y direction and the left-right direction is an X direction. In FIG. 1, the direction of arrow Ya is the front direction, and in FIGS. 1, 2 and others, the direction of Yb is the rear direction from which a cap frame is mounted (or fit).

Figure 8:
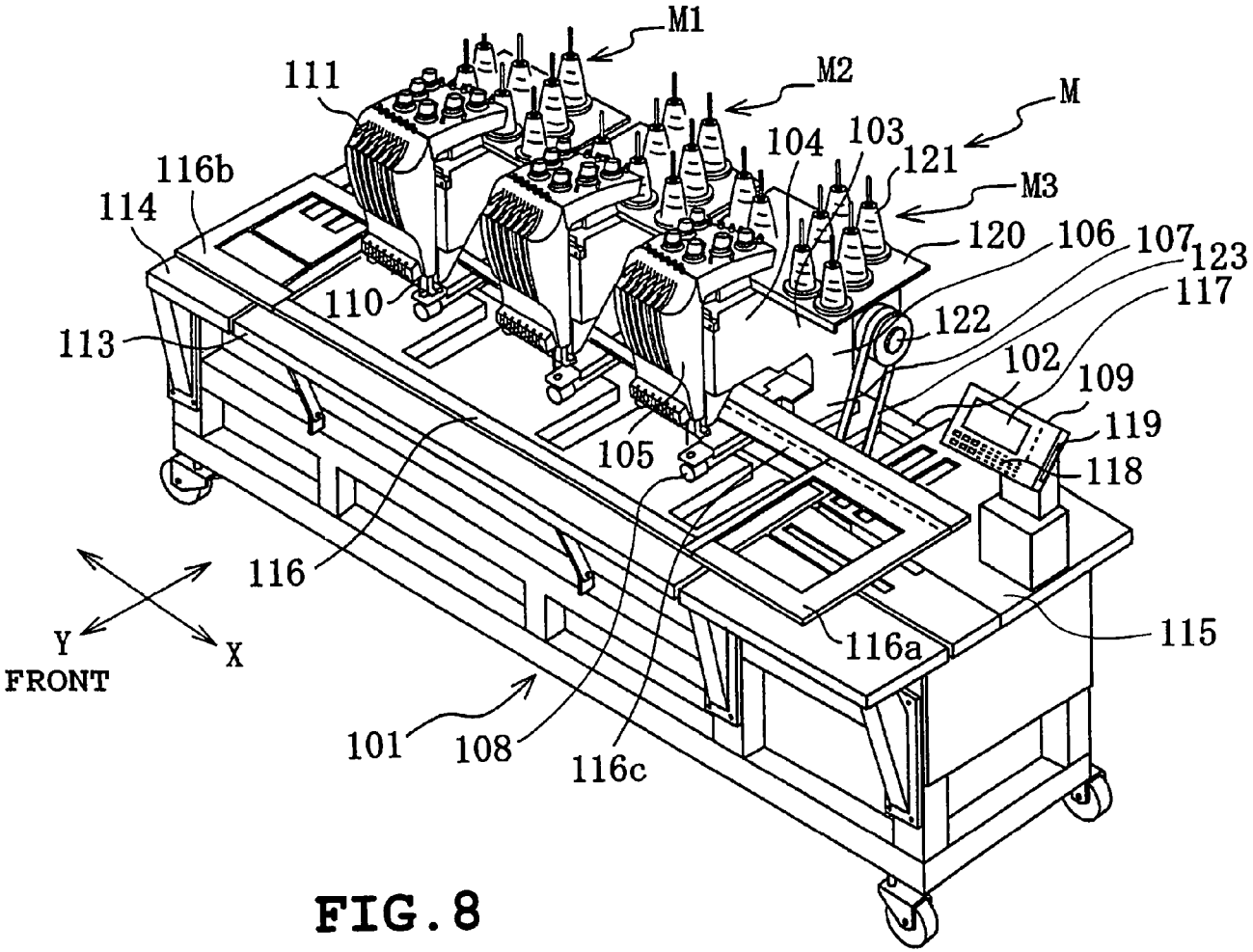
FIG. 8 is a perspective view of the entire multi-head sewing machine.

First, referring to FIG. 8, an explanation will be given of the configuration of a body of a multi-head sewing machine M. The body of the multi-head sewing machine M includes an embroidery-machine base frame 101 extending in an X direction and a nearly-square sewing machine supporting plate 102 arranged on the embroidery-machine base frame 101 on the rear side thereof. In this embodiment, three multi-needle embroidery sewing machines M1 to M3 having the same configuration are arranged on the sewing machine supporting plate 102.

Each of these embroidery sewing machines M1 to M3 is structured as follows. On the sewing machine supporting plate 102, a bed body 107 is arranged. A leg column 106 is provided to extend upward from the rear end of the bed body 107. An arm 103 is provided to extend forward from the upper end of the leg column 106. At the front end of the arm 103, ahead 104 is provided. At the front end of the head 104, a needle case 105 is provided movably in the X direction. At the front end of the bed body 107, a cylinder bed 108 extending forward is provided. On the upper surface of the tip of this cylinder bed 108, a needle slot 108*a* (see FIG. 6) is made; within the slot, a thread circle capturer (not shown) is housed.

Each of the needle case 105 incorporates e.g. six needle bars (not shown) and six balances 111 which are vertically movable. Each needle bar is provided with a sewing needle 110 at its lower end. On the arm 103, a spool holder base 120 having plural spool holders 121 is placed. The sewing needles 110 are supplied with different color (six colors) embroidery threads from the spool holders 121 through the balances 111, respectively.

When the needle bar case 105 is moved in the X direction by a needle bar selecting mechanism (not shown), one of the needle bars to be driven is selected. Only the needle bar (sewing needle 110) thus selected and the corresponding balance 111 are vertically driven by the driving force transmitted from a sewing machine motor (not shown) through a V belt 123 and a main shaft 122. In their cooperation with the thread circle capturer which is likewise rotation-driven by the sewing machine motor, an embroidery seam is made with the embroidery thread with the selected color.

On the front side of the sewing machine supporting plate 102, a working table 113 is arranged which can ascend to the same height as the upper surface of the cylinder bed 108. On both left and right sides of the working table 113, a pair of auxiliary table 114 and 115 are arranged. A cloth transporting frame 116 which is formed as a square frame long in the X direction is provided to extend between the auxiliary tables 114 and 114. This cloth transporting frame 116 includes driving frame segments 116*a*, 116*b* at both ends and X-direction frame segments 116*c*. The driving frame segments 116*a* and 116*b* are placed on and supported by the auxiliary tables 114 and 115, respectively.

In this case, although not illustrated in detail, the portion of the sewing machine supporting plate 102 is provided with a moving mechanism consisting of a X-direction driving mechanism and a Y-direction driving mechanism. The above cloth transporting frame 116 is adapted in a manner such that the driving frame segment 116*a* on the right side is movable in the X direction when it is coupled with the X direction driving mechanism whereas the X-direction driving frame segments 116*c* are movable in the Y direction when they coupled with the Y direction driving mechanism. At the right end of the auxiliary table 115, an operating panel 109 used when an operator makes various entries is provided. The operating panel 109 is provided with a display 117 on which various data such as embroidery data are displayed, an operating switch segment 118 for entry by the operator and a flexible disk drive 119.

Figure 6:
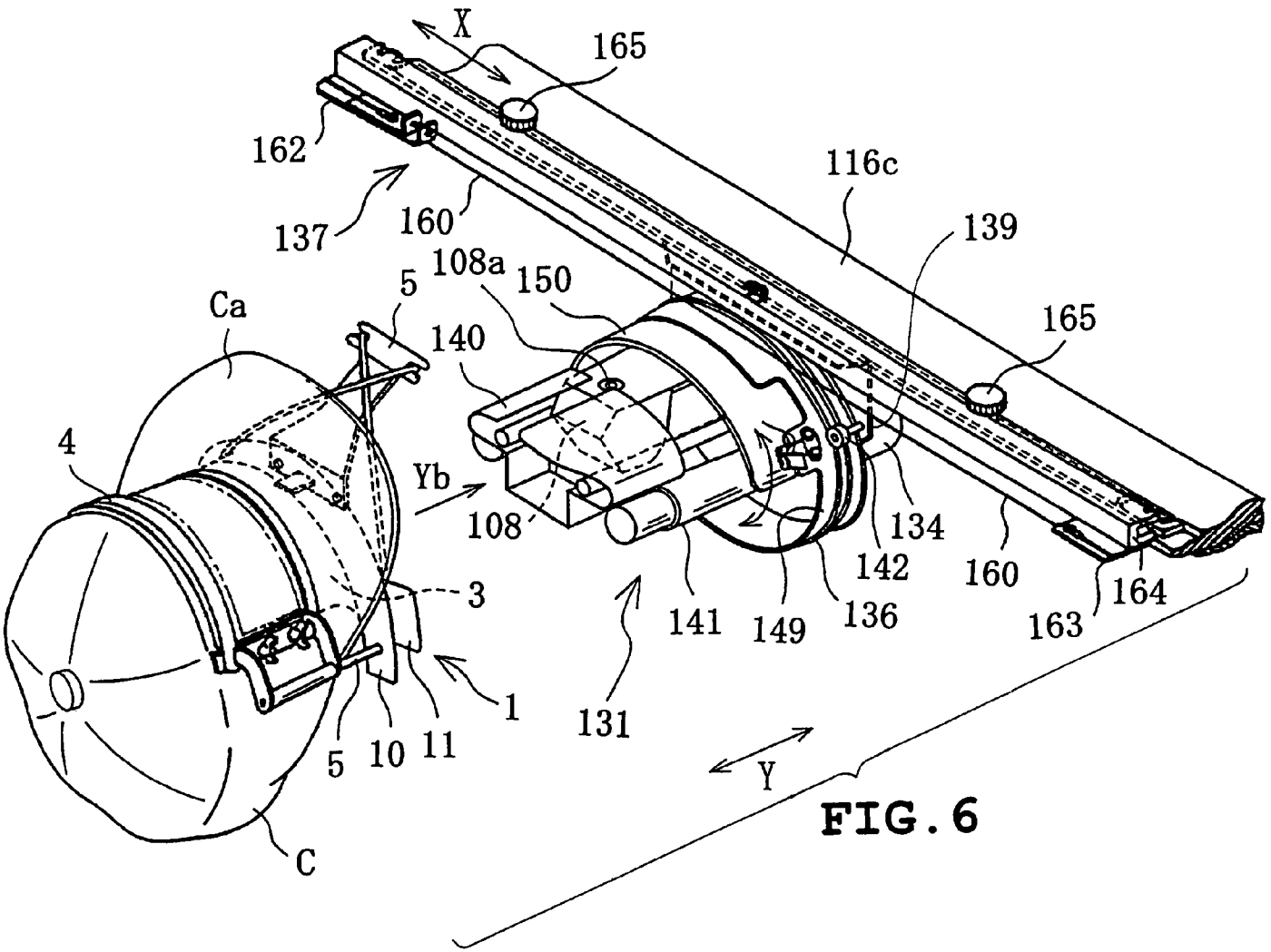
FIG. 6 is a perspective view of the manner in which the cap frame is coupled with a coupling portion.
Figure 7:
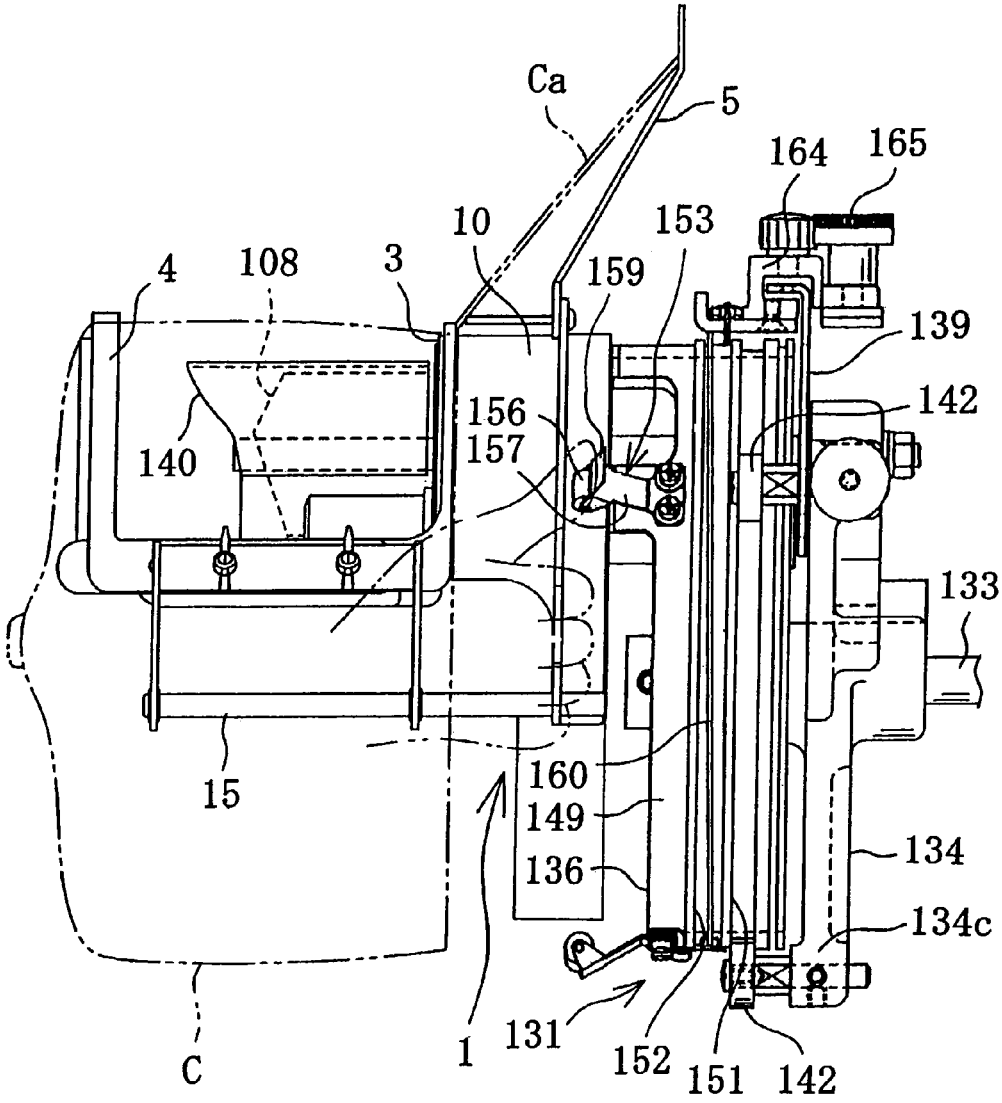
FIG. 7 is a right side view of the status where the cap frame is coupled with the coupling portion.

Although not shown, the multi-head sewing machine M is provided with a control device incorporating a microcomputer. On the basis of the embroidery data and others, this control device controls the above sewing machine motor, needle bar selecting mechanism, X-direction driving mechanism and Y-direction driving mechanism, thereby automatically doing the embroidery for a object to be sewed (cap C) supported by the cloth transporting frame 116.

Where the embroidery is done on the cap C by each of the embroidery sewing machines M1 to M3, a coupling unit 131 is attached to the cloth transporting frame 116. The cap frame 1 with the cap C held is detachably mounted in the coupling unit 131. Referring to FIGS. 6 and 7, an explanation will be given of the above coupling unit 131. Incidentally, as described later in detail, the cap frame 1 according to this embodiment is a "frame type" of cap frame which includes a ring-shaped (thin-cylindrical) cap frame body 2, cap supporting segment 3, holding-down member 4, flange supporting piece 5, etc. The cap C put from the front with the area to be sewed (front in this case) oriented upwards is held in this cap frame 1.

The coupling unit 131 includes a guiding shaft 133 (See FIG. 7) extending in the Y direction (front-rear direction) beneath the cloth transporting frame 116, a base frame 134 supported movably in the Y direction but not rotatably along the guiding shaft 116, a rotating frame 136 rotatably (coaxially rotatably) supported around an axial center O in parallel to the Y direction by the base frame 134, a rotating mechanism 137 for rotating the rotating frame 136 around the axial center O, a coupling mechanism (not shown) for coupling the base frame 134 with the cloth transporting frame 116, a coupling plate 139 attached vertically upwards on the base frame 134, a cap supporting plate 140 for supporting the inner periphery of the cap C attached on the front of the coupling plate 139, a guiding roller 141 for rotatably guiding the above rotating frame 136 from inside, etc.

Although not illustrated in detail, the above guiding shaft 133 is fixed to the above bed body 107. The central boss of the base frame 134 is slidably fit in the guiding shaft 133 so as to be movable in the Y direction along the guiding shaft 133. The coupling plate 139 is fixed onto the upper part of the base frame 134. At the left and right both ends and lower center of the coupling plate 139, three (only two are illustrated in FIG. 7) rotating rollers 142 are provided for supporting the rotating frame 136 from outside. The upper end of the coupling plate 139 is formed as a bending segment 139*a* bending forward.

The rotating frame 136 integrally includes a cylindrical ring-shaped segment 149 and a semi-arc cap frame supporting segment 150 which extends forward by a prescribe length from the upper half of the ring-shaped segment 149. On the outer periphery of the ring-shaped segment 149, formed are a roller groove 151 in which the rotating rollers 142 fit therein and roll relatively and a wire guiding groove 152 for guiding the wire 160 of the rotating mechanism 137. In the cap frame supporting segment 150, the cap frame 1 described later is mounted detachably. At this time, the inner periphery of cap frame 1 is intimately fit in the outer periphery of the cap frame supporting segment 150.

On the left and right upper sides of the outer periphery of the ring-shaped segment 149, a pair of left and right engaging members 13 are provided for firmly engaging the cap frame 1 mounted in the cap frame supporting segment 150 with the rotating frame 136. The engaging members 153 each is provided with an engaging roller 156 rotatably attached to the tip of a flat spring 153. The base side of the flat spring 157 is fixed to the ring-shaped segment 149. By the flat spring 157, the engaging roller 156 is always urged in an engaging direction. When the engaging roller 156 is engaged in the engaging slot 12 (FIG. 1) formed in the cap frame body 2 of the cap frame 1, the cap frame 1 is held in the cap frame supporting segment 150 in a positioned state in the front-rear direction and circumferential direction. The engaging members 153 each is provided with a projecting piece 159 formed integrally to the flat spring 157; the projecting piece 159 is employed when the operator pressure-shifts the engaging member 153 (flat spring 157) in an engaging releasing direction.

A pair of the cap supporting plates 140 are provided at both the left and right sides of the cylinder bed 108 in front of the cap frame supporting segment 150. These cap supporting plates 140 are fixed to the coupling plate 139 in their rear ends, and when these cap supporting plates relatively slide on the inner periphery of the cap C, they stretch cloth in a prescribed range over both the left and right sides of a needle slot 108*a* of the cap C.

The rotating mechanism 137 serves to convert the movement in the X direction of the cloth transporting frame 116 into the rotation of the rotating frame 136. The rotating mechanism 137 includes a wire 160 wound on the wire guiding groove 152 of the rotating frame 136, and a moving member 164 which is coupled with a fixed member (not shown) length in the X direction attached to the cloth transporting frame 116 by means of a screw member 165 and is movable relatively to the base frame 134 in the X direction. The movable member 164 is provided with wiring coupling segments 162, 163 which couple both ends of the wire 160 at its both ends. The movable member 164 is integrally provided with an engaging segment with which the upper end bending segment 139*a* of the coupling plate 139 is to be engaged.

In this case, the pair of left and right guiding rollers 141 are rotatably supported by the coupling plate 139, and are located at the positions corresponding to the pair of left and right rotating rollers 142 provided on the upper sides. These guiding rollers 141, which are fit in the roller groove formed on the inner periphery of the rotating frame 136, sandwich the rotating frame 136 together with the rotating roller 142 to support the rotating frame 136 rotatably. In the rotating mechanism 137 having the configuration described above, when the cloth transporting frame 116 is driven in the X direction, the movable member 164 moves together with the cloth transporting frame 116 in the X direction. By this movement, the rotating frame 136 with the wound wire 160 whose both ends are fixed to the movable member 164 is rotated.

Further, the above coupling mechanism also serves to transmit the Y direction driving of the cloth transporting frame 116 to the coupling unit 131 in such a manner that the base frame 134 is coupled with the cloth transporting frame 116 so that they can be moved and driven simultaneously in the Y direction and can be moved relatively in the X direction. Thus, the coupling unit 131 can be moved for the cylinder bed 108 in the front-rear (Y direction).

Next, referring to FIGS. 1 to 5, an explanation will be given of the cap frame 1 according to this embodiment. This cap frame 1 is detachably coupled with the coupling unit 131 of the embroidery sewing machine M1 to M3. In addition, in attaching or detaching the cap C, the cap frame 1 is detachably attached to the cap-frame setting frame 6 (See FIG. 4) described later in a state where it is dismantled from the embroidery sewing machine M1 to M3.

The cap frame body 2 is mounted in the cap frame supporting segment 150 of the coupling unit 131 (and base frame 7 of the cap-frame setting frame 6) in its state where it is fit from outside. At this time, the center of the cap frame body 2 aligns with the above axial center. The cap frame body 2 integrally includes an attaching frame 10 and a grip(s) 11 which projects left and right sideward from the outer periphery of the attaching frame 10. The attaching frame 10 has two engaging slots 12. In the these engaging slots 12, the two engaging rollers 156 provided in the rotating frame 136 are engaged, and the two engaging rollers 8 (See FIG. 4) of the cap-frame setting frame 6 are also engaged. The cap supporting segment 3 is integrally provided to project forward from the upper half of the attaching frame segment 10.

The cap supporting segment 3 is formed in a semi-arc (curved) shape with respect to the center (axial center O) of the cap frame body 2 in the front-rear direction, and is formed in a frame shape having a square opening corresponding to an area to be embroidered (area to be embroidered on the front of the cap C) when viewed from above. With the area to be embroidered (front in this case) oriented upward, the cap C is set in the cap supporting segment 3 so that it is covered from outside. Thus, the cap supporting segment 3 receives the periphery of the area to be embroidered of the inner periphery of the cap C.

The holding-down member 4 serves to hold down the vicinity of the area to be embroidered of the cap C from outside surface of the cap C for the cap supporting segment 3. The holding-down member 4 is formed in a curved square frame shape corresponding to the cap supporting segment 3 and has slight flexibility. In this case, as seen from FIGS. 1 and 3, on the lower left part of the cap frame body 2, a rod 15 which projects forward is provided. The one end (left edge) in the holding-down member 4 is rotatably attached to the rod 15. On the other hand, on the lower right part of the cap frame body 2, a lug member 16 is provided. On the other end (right edge) of the holding-down member 4, a hook member 17 to be detachably engaged with the lug member 16 is provided.

Thus, the holding-down member 4 can be opened/closed between an opened state greatly remote from the cap supporting segment 3 and a closed state superposed on the outer periphery of the cap supporting segment 3. In setting the cap C in the cap frame 1, first the cap C is put on the cap supporting segment 3 from the front in the opened state of the holding-down member 4. Next, the holding-down member 4 is rotated so that it is put on the front of the cap C from above, thereby engaging the hook member 17 with the lug 16. Thus, the front of the cap C is sandwiched between the cap supporting segment 3 and holding-down member 4 so that the cap C is held in the cap frame 1 with the cloth of the area to be embroidered being stretched in the frame.

The flange supporting body 5 serves to support the flange Ca of the cap C. The lower end thereof is attached to the central upper end of the cap frame body 2. The flange supporting body 5 is provided so as to rise rearward obliquely upward. On the upper end of the flange supporting body 5, a flange fixing mechanism 14 is provided for fixedly nipping the tip of the flange Ca of the cap C.

At the upper end of the cap frame body 2, a receiving member 13 located in front of the flange supporting body 5 is provided for nipping and holding a sweat absorbing area (not shown) of the cap C. The sweat absorbing area of the cap C is provided to be folded back to the inner periphery of the opening of the cap C. And with sweat absorbing area being opened on the front side of the cap C, the sweat absorbing area is held in the receiving member 13.

It should be noted that regardless of the fixed state of released state of the flange Ca by the flange fixing mechanism 14, the outer end of the flange supporting body 5 is exposed to the outside. As seen from FIGS. 2 and 4, at the outer end of the flange supporting body 5, a cap central reference line 5*a* is marked on the upper surface thereof. On the upper surface of the receiving member 13 also, a cap central reference line 13*a* is marked. These cap central reference lines 5*a*, 13*a* are lines marked on the flange supporting body 5 and the flange receiving member 13 and clearly colored in e.g. red.

Meanwhile, as seen from FIGS. 1 to 5, of the cap supporting segment 3, at the center thereof in the circumferential direction (left-right direction) of the edge (long side extending in the circumferential (left-right) direction, a cap central reference area 20 is formed. As seen from FIG. 5, the cap central reference area 20 is formed of a recess 21 made by recessing the edge on the cap top side of the cap supporting segment 3. This recess 21 is formed in a V-shape narrowed from the cap top side (front) to the cap opening side (rear). Thus, the cap central reference area 20 can be tactually recognized (known in touch) when the operator touches it from the outside surface of the cap put on the cap supporting segment 3 by his/her hand/finger.

More concretely, for example, in order that the tip of the index finger of a general man can be inserted from the rear side through the cloth of the cap C, the recess 21 is formed with the size of about 12 mm in left-right width, about 9 mm in front-rear length and about 65° in angle at the rear end. Further, as seen from FIGS. 2 and 4, the left-right width (about 12 mm) is made larger than the width of a central seam CS formed at a circumferential center CC on the front of a general cap C. For this reason, the entire area of the central seam CS can enter the recess 21.

Figure 4:
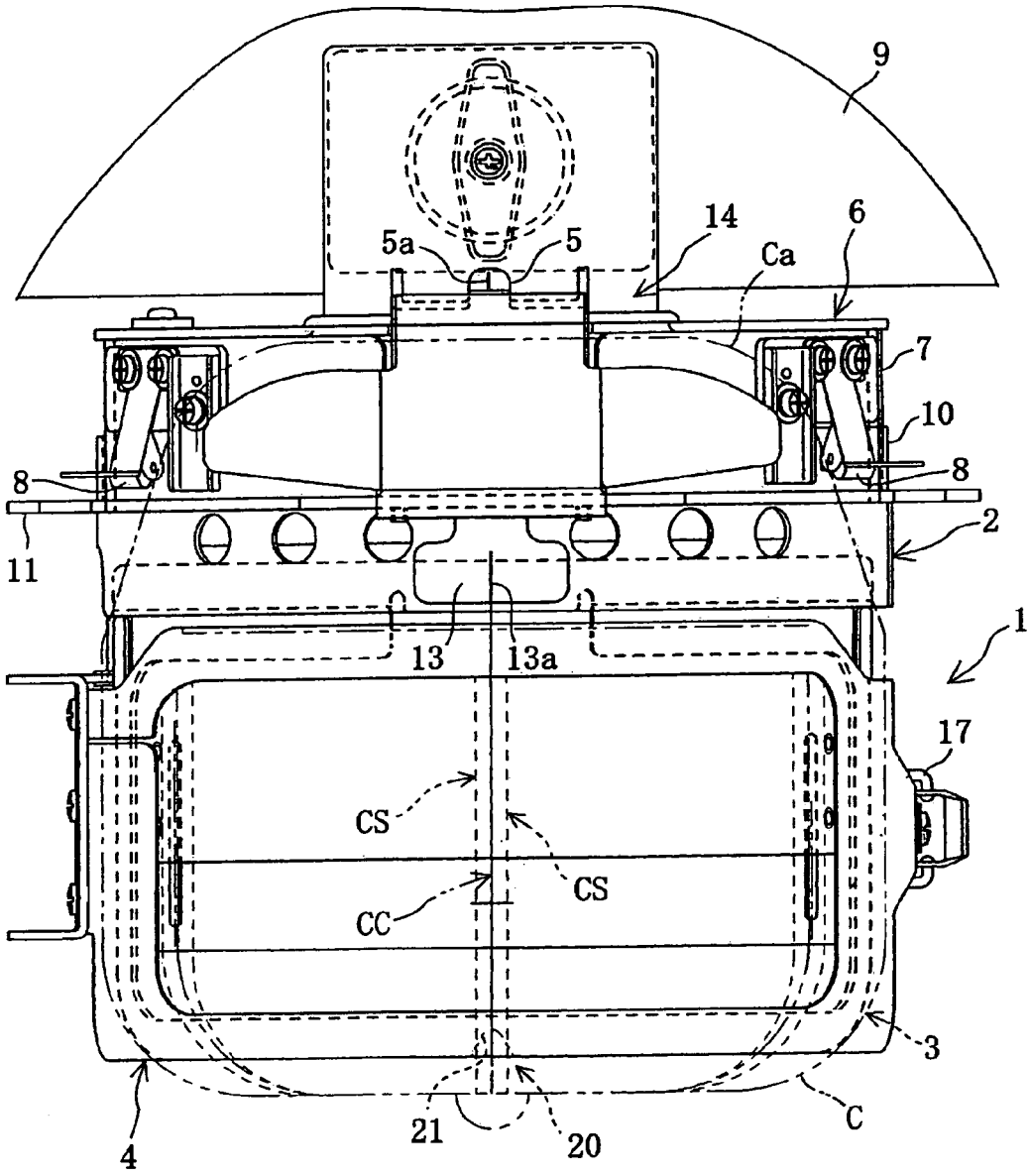
FIG. 4 is a plan view of the status where the cap frame is attached to a cap-frame setting frame.
Figure 5:
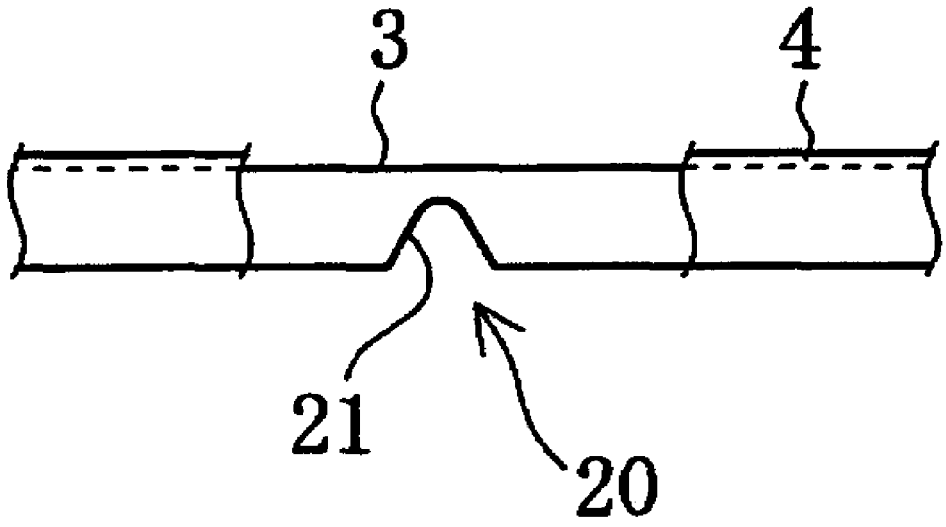
FIG. 5 is a top view of the main part of the cap frame partially recessed.

Incidentally, although not illustrated nor described in detail, the cap-frame setting frame 6, as partially shown in FIG. 4, is provided with a semi-cylindrical base frame 7 which is fixed to a working table at the rear end and is extended forward. The base frame 7 is provided with engaging members (engaging rollers 8) which are similar to the pair of engaging members 153 (engaging rollers 156) attached to the rotating frame 136 of the coupling unit 131. The cap frame 1 is fit into the outer periphery of the base frame 7 from the outside so that the engaging rollers 8 are engaged in the engaging slots 12 of the attaching frame segment 10, thereby attaching the cap frame 1 to the cap-frame setting frame 6.

Next, an explanation will be given of the operation and effect of the cap frame 1 according to this embodiment constructed as described above.

Where the operator sets the cap C in the cap frame 1, first, as seen from FIG. 4, he or she firmly fits the cap frame body 2 of the cap frame 1, from outside, to the base frame 7 of the cap-frame setting frame 6 fixed to a predetermined working table 9. Next, with the holding-down member 4 being opened for the cap supporting segment 3, he or she puts the cap C on the cap supporting segment 3. In this case, while seeing the cap central reference lines 5*a*, 13*a* and cap central reference area 20, the operator sets the cap C in an aligned status where the center of the cap frame 1 aligns with the center CC on the front of the cap C. In this case, there is the following situation. Namely, although the flange Ca of the cap C can be positioned so that its center is aligned with the cap central reference line 5*a*, once the cap has been put on the cap supporting segment 3, the cap central reference line 13*a* and cap central reference area 20 are concealed from view by the cap C.

However, in accordance with this embodiment, the cap supporting segment 3 is provided with the cap central reference area 20 which is recognizable tactually in touch therewith from the outside surface of the cap. For this reason, in aligning the cap C, without visually recognizing the center line, while tactually recognizing the cap central reference area 20 in touch therewith through the cloth of the cap C by a hand or finger, the operator can easily align the cap C by superposing the cap central reference area 20 is superposed on the center of the cap C.

With the center CC of the cap C being held down on the cap central reference area 20 by his/her hand/finger, the holding-down member 4 is rotated to be superposed on the cap C so that the hook member 17 is engaged with the lug member 16. Thus, while preventing the cap C from being misaligned from the cap supporting segment 3, the cap C can be set in the cap frame 1 in the aligned state (the center CC of the cap C is aligned with the center of the cap frame 1). Incidentally, thereafter, the cap frame 1 with the cap C held is taken off from the cap-frame setting frame 6 and coupled with the embroidery sewing machine M1 to M3. In this state, the embroidery is done on the cap C. At this time, since the cap C has been accurately aligned with the cap frame 1, the embroidery can be accurately done at a prescribed position of the cap 1.

As described above, in accordance with the cap frame 1 according to this embodiment, since the cap central reference area 20 which is tactually recognizable is formed on the cap supporting segment 3, the alignment in putting the cap C on the cap supporting segment 3 can be easily done. In addition, while preventing the cap C from being misaligned, the cap C can be consecutively held down on the cap supporting segment 3 by the holding-down member 4. Thus, unlike the case where the operator visually recognizes the center line for alignment, the alignment in holding the cap C in the cap frame 1 can be done easily and surely. This leads to an excellent effect of enhancing the positioning accuracy of the embroidery done on the cap C. Particularly, in accordance with this embodiment, since the cap central reference area 20 is formed of the V-shape recess 21, while holding down the center CC of the cap C on the recess 21 by his/her hand/finger thereby to prevent the cap C from being misaligned, the alignment can be done surely.

Figure 9:
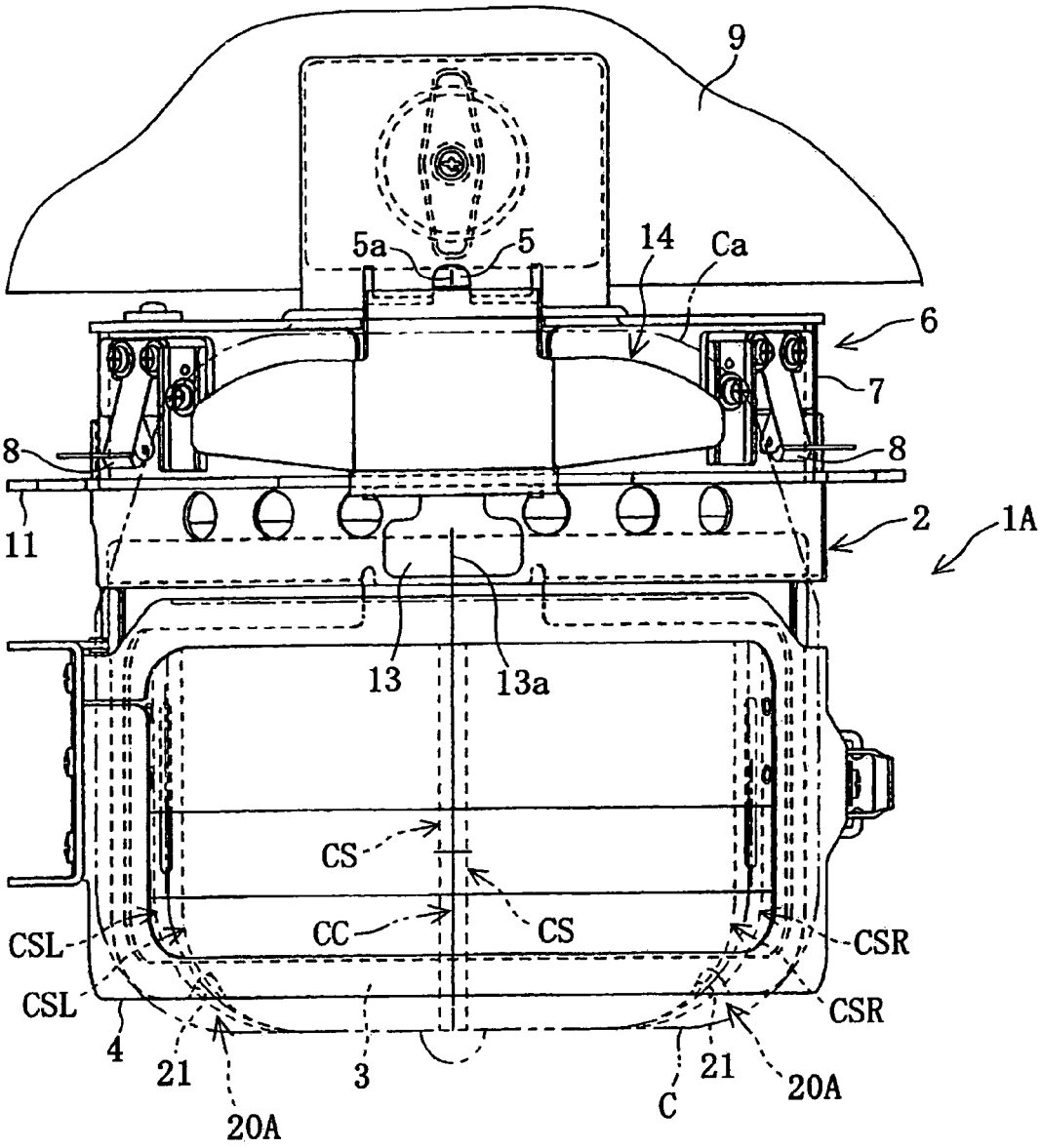
FIG. 9 is a front view of a cap frame according to a second embodiment of this invention.
Figure 10:
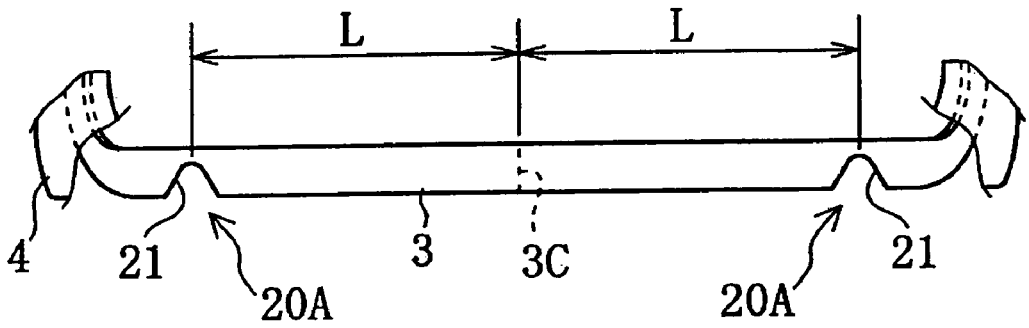
FIG. 10 is a plan view of the main part of the cap frame partially recessed.

FIGS. 9 and 10 show a second embodiment of this invention. Incidentally, a cap frame 1A according to this embodiment is different from the cap frame 1 according to the first embodiment in that a pair of cap positioning reference areas 20A are provided in place of the cap central reference area 20 at the edge of the cap top side (front) of the cap supporting segment 3. Therefore, with like reference symbols referring to like parts in the first embodiment, a detailed explanation and new illustration will be omitted. Only the main points of this embodiment will be described below.

As seen from FIG. 9, the cap frame 1A includes a ring-shaped cap frame body 2, a cap supporting segment 3 having a curved square frame shape formed integrally to the cap frame body 2, a frame-shaped holding-down member 4 for holding, from outside, the periphery of an area to be embroidered of the cap C on the cap supporting segment 3, and a flange supporting body 5 for supporting the flange Ca of the cap C. In this embodiment, the cap positioning reference areas 20A are formed at two points of the edge of the cap top side (front) of the cap supporting segment 3.

As also seen from FIG. 10, a pair of the cap positioning reference areas 20A are formed at the positions remote from the center 3C toward both sides by predetermined equal lengths L of the edge (long-side part extending in a circumferential (left-right) direction) of the cap top side (front side) of the cap supporting segment 3. In this case, as seen from FIG. 9, the respective cap positioning reference areas 20A are located at e.g. the positions aligned with the seams CSR and CSL which are formed laterally symmetrically on the front of the cap C. In this embodiment also, each cap positioning reference area 20A is formed of the V-shape recess 21 similar to the cap central reference area 20. When the operator touches the recess by his/her hand/finger from outside surface of the cap C put on the cap superposing segment 3, he or she can recognize tactually.

In accordance with such a cap frame 1A according to this embodiment, as previously said, in setting the cap C, while tactually recognizing the cap positioning reference areas 20A through the cloth of the cap C by his/her hand/finger, the operator can align the seams CSL and CSR of the cap C with the pair of cap positioning reference areas 20A. Thus, the center of the cap frame 1A can be aligned with the center of the cap easily and surely.

Figure 11:
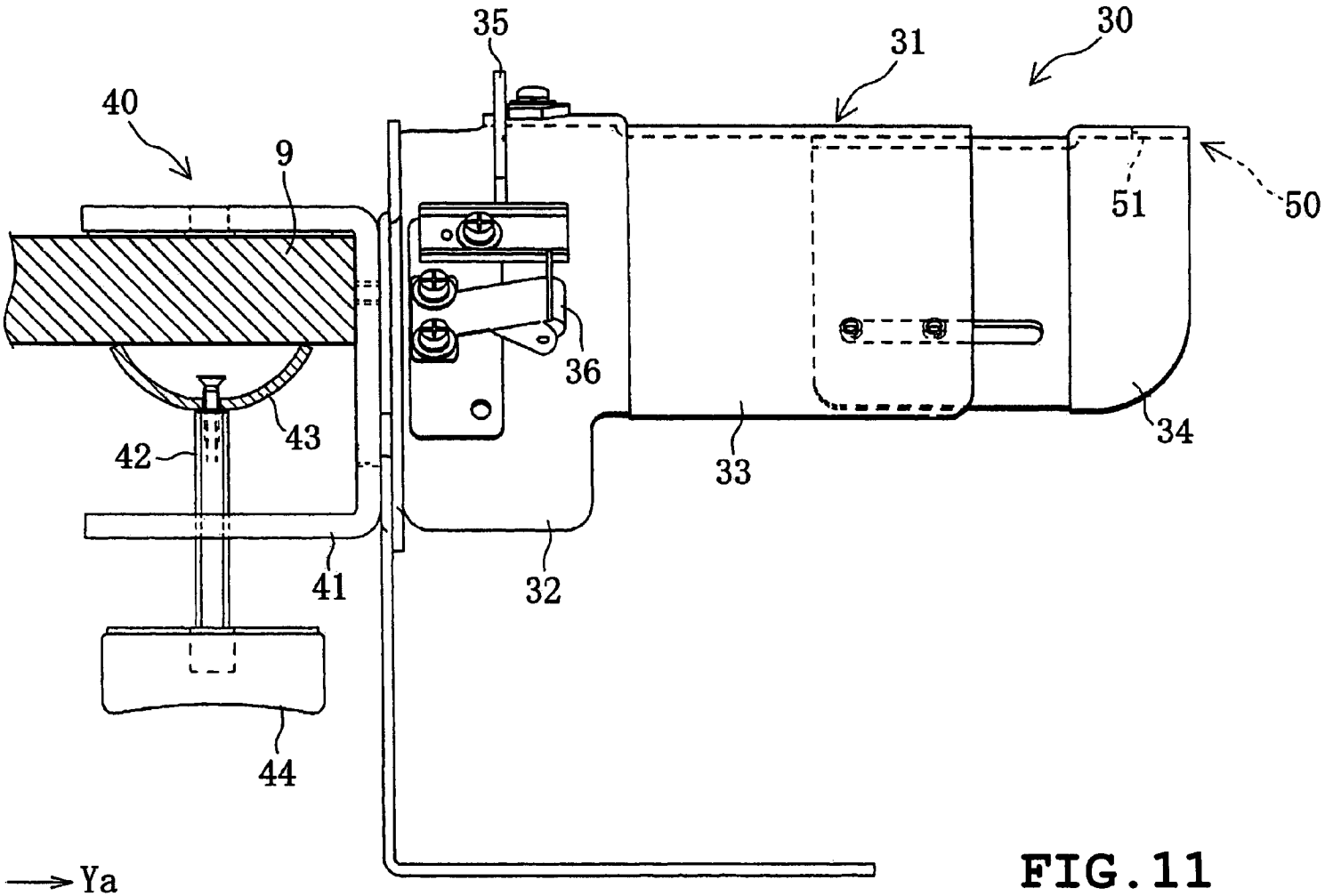
FIG. 11 is a side view of a cap-frame setting frame according to a third embodiment of this invention.

Next referring to FIGS. 11 to 14, an explanation will be given of a third embodiment of this invention. In this embodiment, this invention is applied to a cap-frame setting frame 30 with a cap frame 60 for holding the cap C being detachably attached. In this embodiment, the cap frame 60 is a cap frame of "non-frame" type. Incidentally, in the following description, it is assumed that the direction indicated by arrow Ya in FIG. 11 is a forward direction, and others.

As seen from FIGS. 11 to 14, the cap-frame setting frame 30 according to the invention includes a base frame 31 to which a cap frame body 61 of the cap frame 60 is attached in its positioned status, a fixing mechanism 40 provided at the rear end of the base frame 31 for fixing the cap-frame setting frame 30 to the working table 9, etc.

The fixing mechanism 40 includes an attaching member 40 having a ⊃-shape when viewed from the side, a screw member 42 screw-engaged to pass through a screw hole of the lower part of the attaching member 41, a tightening member 43 provided at the upper end of the screw member 42 and a knob member 44 provided at the lower end of the screw member 42. In this configuration, by locating the attaching member 41 so as to sandwich the working table 9 between the upper part of the attaching member 41 and the tightening member 43 and tightening the tightening member 43 by rotation of the knob 44, the cap-frame setting frame 30 is fixed to the working table 9.

The base frame 31 includes a partially-cylindrical frame body 32 located at the base (rear end) side, a nearly semi-cylindrical frame-supporting frame 33 which is fixed to the frame body 32 to extend forward, and a nearly semi-cylindrical movable-frame supporting frame 34 attached to the front of the frame-supporting frame 33. In this case, the movable-frame supporting frame 34 is coupled with the frame supporting frame 33 so that its length can be adjusted by sliding back and forth. The position of the movable-frame supporting frame 34 is adjusted according to the height (depth) of the cap C. The frame body 32 is provided with a flange 35 for receiving the rear end of the cap frame 60, and two engaging rollers 36 to be engaged in two engaging slots 72 (see FIG. 15) of the cap frame 60.

Figure 12:
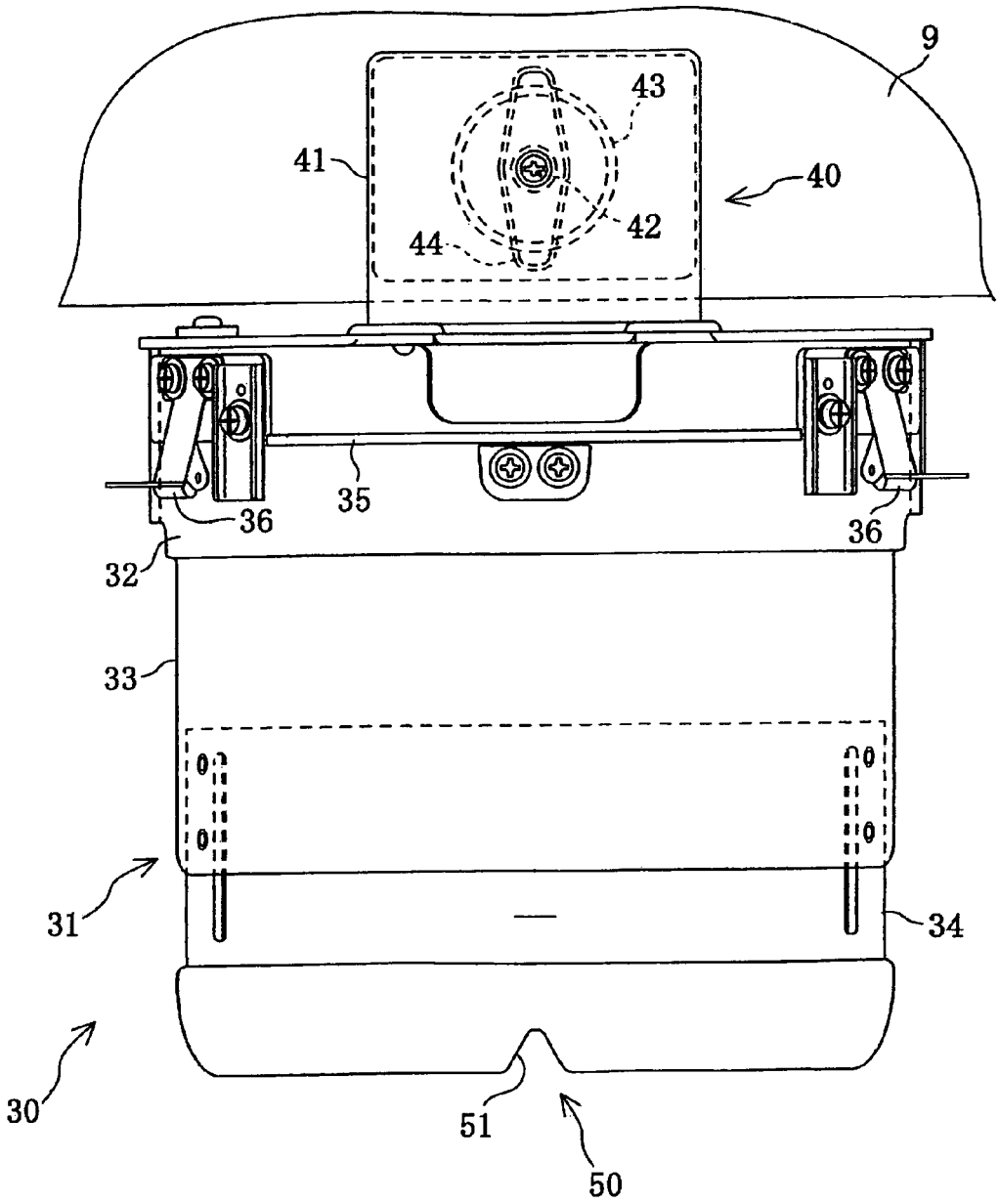
FIG. 12 is a plan view of a cap-frame setting frame.
Figure 13:
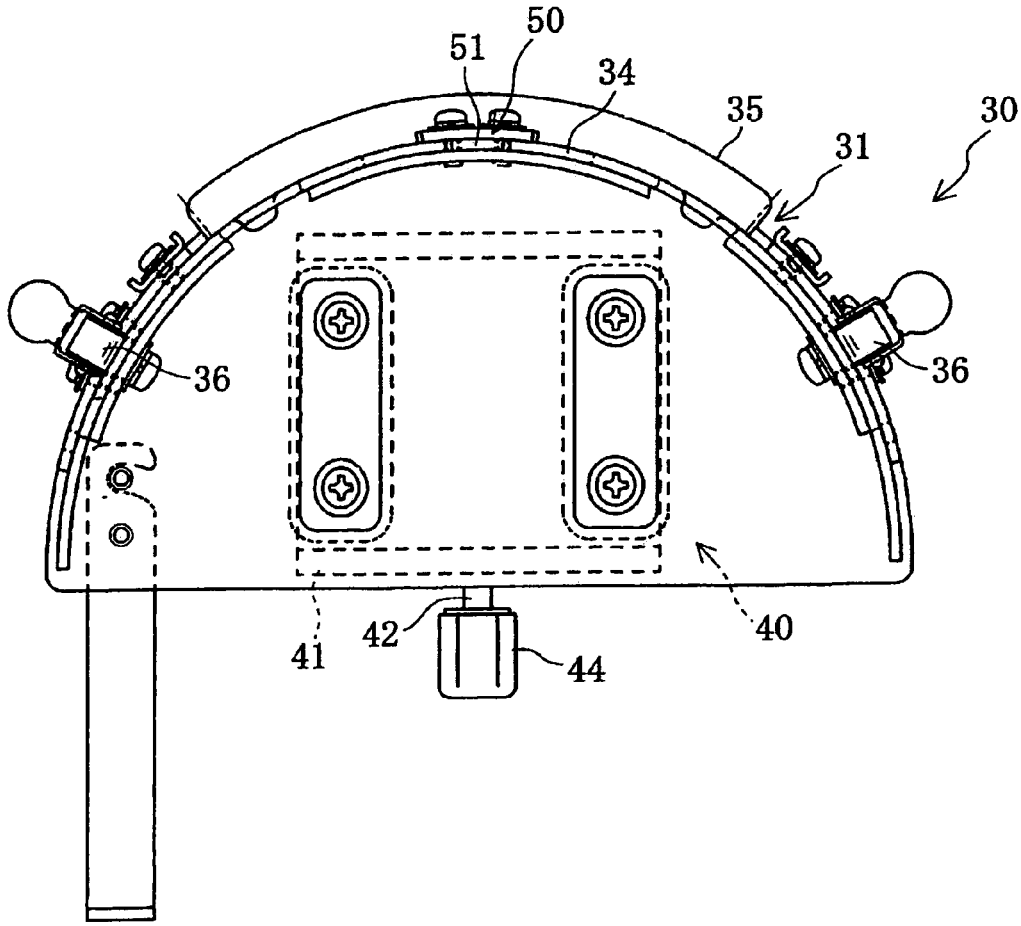
FIG. 13 is a front view of a cap-frame setting frame.
Figure 14:
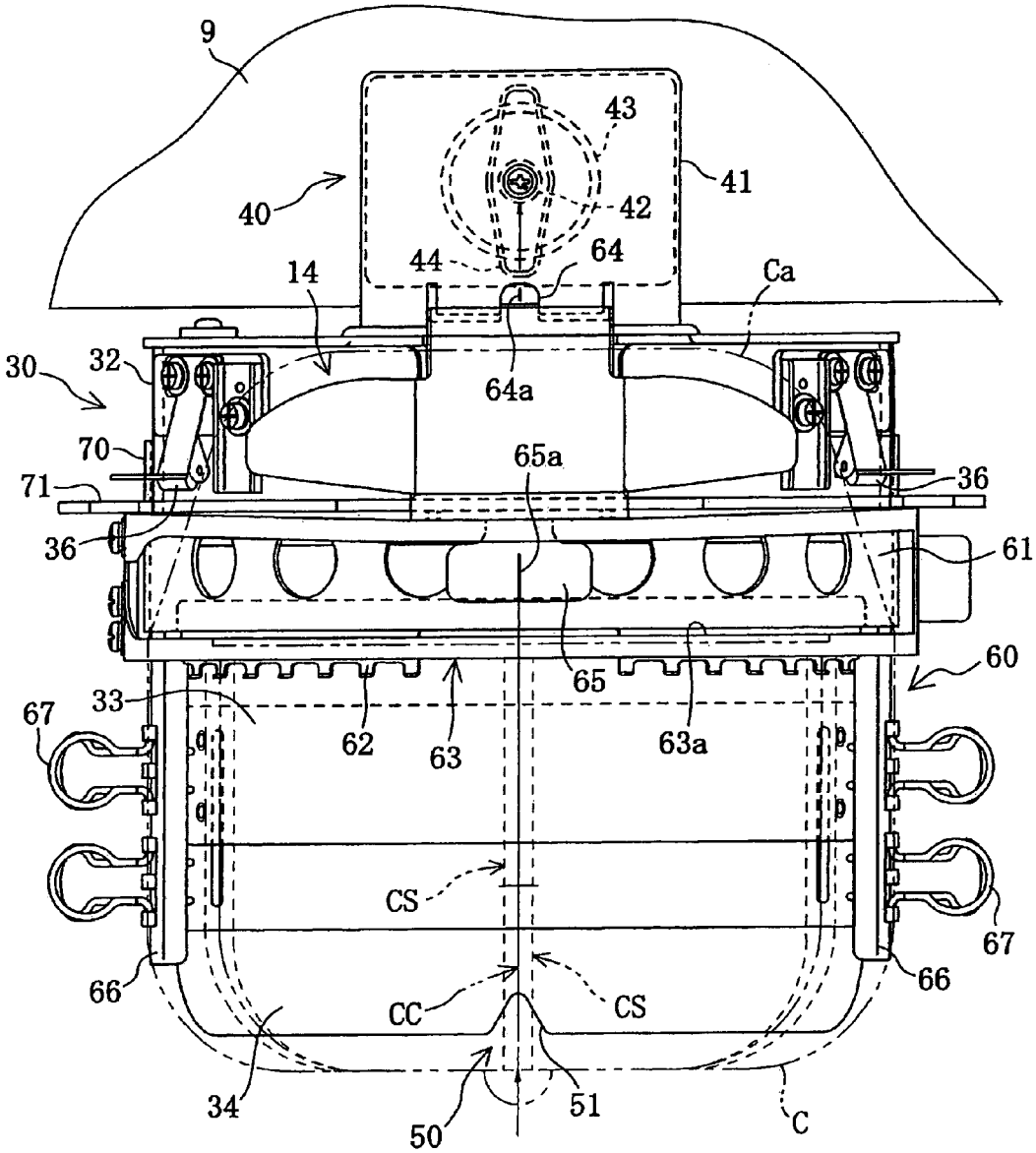
FIG. 14 is a plan view of the status where the cap frame is attached to the cap-frame setting frame.

Meanwhile, as seen from FIGS. 12 and 14, in accordance with this embodiment, a cap central reference area 50 is formed at the circumferential center of an edge of the cap top side (front) of the base frame 31, i.e. at the center of the front end of the movable frame supporting frame 34. The cap central reference area 50 is formed of a recess 51 made by recessing the front end edge of the movable frame supporting frame 34 similarly in the first embodiment. This recess 51 is formed in a V-shape narrowed from the top side (front) of the cap to the cap opening side (rear) Thus, the cap central reference area 50 can be tactually recognized when the operator touches it by his/her hand/finger from the outside surface of the cap C put on the cap supporting segment in the attaching state of the cap frame 60.

In this case, as described previously, in order that the tip of the index finger of a general man can be inserted from the rear side through the cloth of the cap C, the recess 51 is formed with the size of about 12 mm in left-right width, about 9 mm in front-rear length and about 65° in angle at the rear end. Further, as seen from FIG. 14, the left-right width (about 12 mm) is made larger than the width of a central seam CS formed at a circumferential center CC on the front of a general cap C. For this reason, the entire area of the central seam CS can enter the recess 51.

Figure 15:
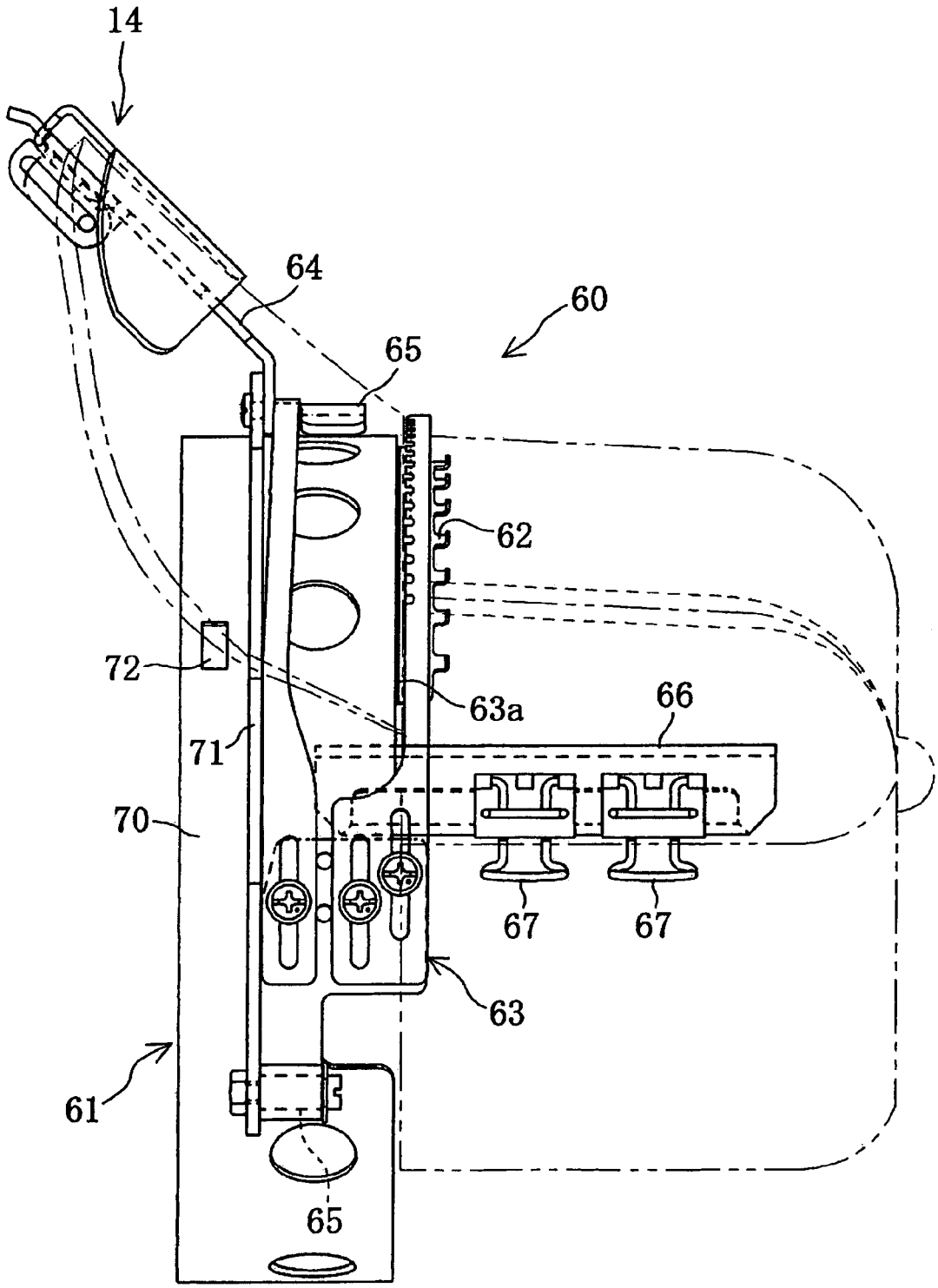
FIG. 15 is a left side view of a cap frame.
Figure 16:
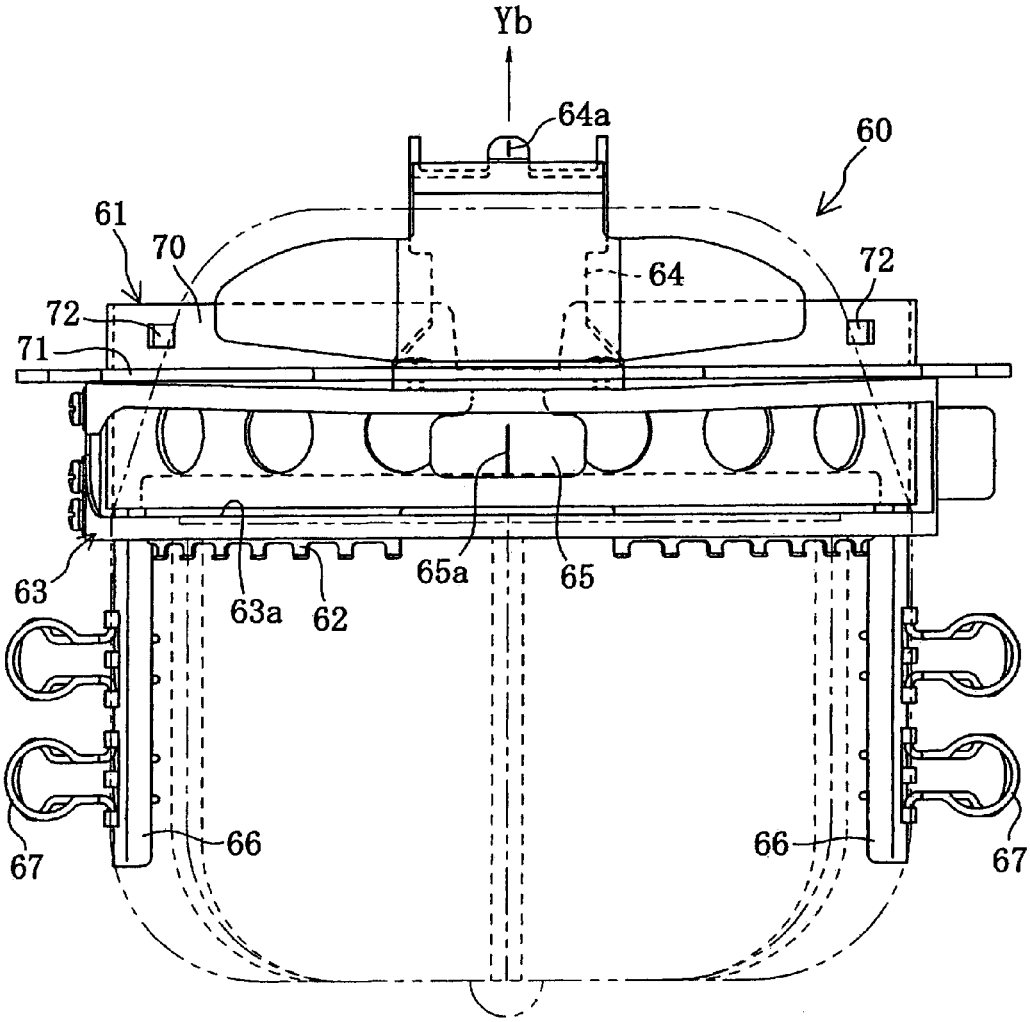
FIG. 16 is a plan view of the cap frame.

Incidentally, as seen from FIGS. 14 to 16, the cap frame 60 includes a cylindrical cap frame body 61 attached to be fit in the base frame 31 of the cap-frame setting frame 30 from outside, a cap supporting segment 62 for receiving the area to be embroidered of the cap C, which is formed integrally to the cap frame body 61, a holding-down member 63 for holding down the vicinity (front) of the area to be embroidered of the cap C, a pair of bars 66 for receiving the circumferential both side segments (left and right sides) of the area to be embroidered of the cap C, which extend forward on the left and right sides of the cap frame body 61, four (in all) clips 67 for fastening the cloth of the cap C to the respective bars 66, and a flange supporting body 64 for supporting the flange Ca of the cap C, provided on the cap frame body 61.

The cap frame body 61 is provided with knobs 71 on the left and right outer peripheries of the cylindrical attaching frame 70. The attaching frame 70 is provided with two engaging slots 72. At the upper end of the cap frame body 61, receiving members 65 for sandwich-holding the sweat absorbing segment of the cap C, located at the front of the flange supporting body 64 are provided. At the upper end of the flange supporting body 64, a flange fixing mechanism 14 is provided for nip-fixing the tip of the flange Ca of the cap C. On the outer surface of the flange supporting body 64, a cap central reference line 64 is marked. Also on the upper surface of the receiving member 65, a cap central reference line 65*a* is marked.

The holding-down member 63 has an opening 63*a* for passing the flange Ca of the cap C, which is formed as a frame with a narrow width curved in a semi-arc shape. The left lower end of the holding-down member 63 is pivotally supported onto the cap frame body 61 by a pivoting shaft 65. Although not shown, at the right lower end of the holding-down member 63, a hook member is provided so as to be engageable with the lug member provided on the side of the cap frame body 61. The rear (the opening side of the cap) of the area to be embroidered of the cap C is held by the cap supporting segment 62 and holding-down member 63, whereas both sides of the area to be embroidered of the cap C are held by the bars 66 and clips 67.

In the configuration described above, when the cap frame 60 is attached to the cap-frame setting frame 30 fixed to the predetermined table 9, as shown in FIG. 14, the cap central reference area 50 formed at the center of the front end of the movable frame setting frame 34 is located at the position corresponding to the cap top side on the front of the cap C. Where the operator sets the cap C in the cap frame 60, with the holding-down member being opened, the cap C is put on the cap supporting segment 62. At this time, while seeing the cap central reference lines 64*a*, 65*a* and cap central reference area 50, the operator aligns the center of the cap frame 60 with the center of the cap C.

And after the cap C has been put on the cap supporting segment 62, while pressing and tactually recognizing the cap central reference area 50 through the cloth of the cap C by his/her hand/finger, the operator can easily make an alignment by superposing the cap central reference area 50 and circumferential center CC of the cap C each other. Further, the holding-down member 63 is put on the cap C and the clips 67 are fastened to the bars 66 through the cloth of the cap C. Also during this operation, misalignment of the cap C can be prevented by holding down the circumferential center CC of the cap C on the cap central reference area 50 by his/her hand/finder.

Thus, in accordance with the cap-frame setting frame 30 according to this embodiment, since the cap central reference area 50 which is tactually recognizable is formed at the front end of the base frame 31, like the first embodiment described above, the alignment in putting the cap C on the cap frame C for its setting can be easily done. In addition, while preventing the cap C from being misaligned, the cap C can be consecutively held down. Thus, the alignment in holding the cap C in the cap frame 60 can be done easily and surely. This leads to an excellent effect of enhancing the positioning accuracy of the embroidery done on the cap C.

Figure 17:
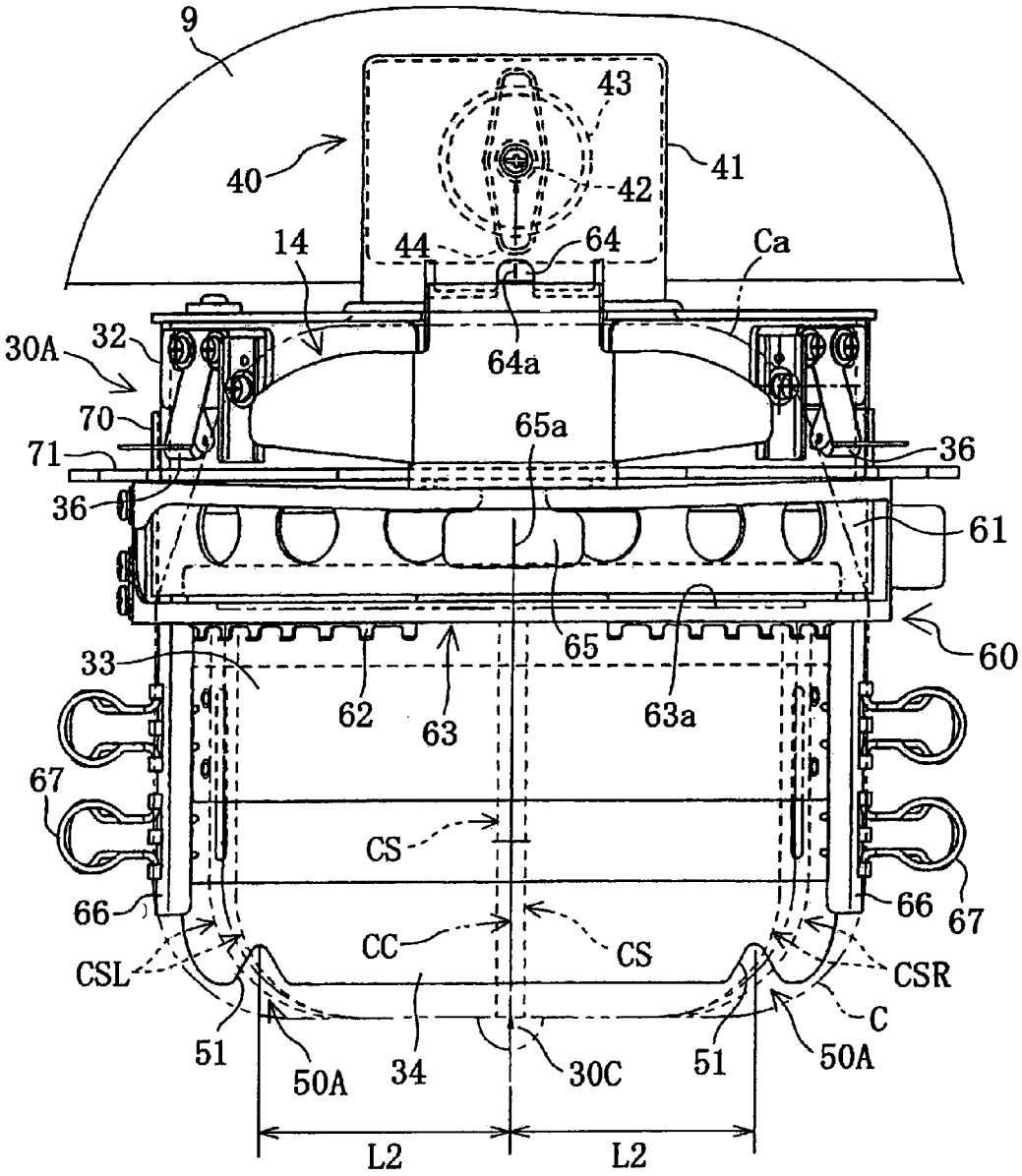
FIG. 17 is a plan view of the status where a cap frame is attached to a cap-frame setting frame according to a fourth embodiment of this invention.

FIG. 17 shows the manner in which the cap frame 60 is attached to the cap-frame setting frame 30A according to the fourth embodiment of this invention. The cap-frame setting frame 30A according to this embodiment is a cap-frame setting frame in which a pair of positioning reference areas 50A are provided in place of the cap central area 50 in the cap-frame setting frame 30 according to the third embodiment. Therefore, with like reference symbols referring to like parts in the third embodiment, a detailed explanation and new illustration will be omitted.

The cap-frame setting frame 30A is provided with a pair of the cap positioning reference areas 50A, which are tactually recognizable by an operator's hand/finger through the cap C put on the cap supporting segment 62 of the cap frame 60, at the positions remote from the center 30C toward both sides by predetermined equal lengths L2 in the circumferential direction of the edge of the cap top side (front) of the base frame 31. Each cap positioning reference area 50A is formed of a V-shaped recess 51 like the cap central reference area 50 in the third embodiment of this invention.

In accordance with the cap-frame setting frame 30A according to this embodiment, like the third embodiment, when the operator sets the cap C in the cap frame 60, while tactually recognizing the cap positioning reference areas 50A through the cloth of the cap C by his/her hand/finger, the operator can easily align the seams CSL and CSR of the cap C with the pair of cap positioning reference areas 50A. Thus, the center of the cap frame 60 can be aligned with the center of the cap C easily and surely.

Hereinbelow, an explanation will be given of various partial modifications of the cap frames 1 and 1A according to the first and the second embodiment and the cap-frame setting frame 30 and 30A according to the third and the fourth embodiment.

1) The recess which constitutes the cap central reference area 20, 50, or cap positioning reference area 20A, 50A may be formed in not only the V-shape but in various shapes such as a U-shape and a semi-circle.

2) The cap central reference area 20, 50 or cap positioning reference area 20A, 50A may be formed as a projection which protrudes upwards or an impression which sinks downward.

3) The cap positioning reference area 20A, 50A may be not only as one pair but also as two or more pairs.

4) The cap central reference area 20, 50 or cap positioning reference area 20A, 50A may be formed as a projection which protrudes toward the cap top side (front).

5) The cap frame may be provided with both cap central reference area 20 and cap positioning reference area 20A.

The cap-frame setting frame may also be provided with both cap central reference area 50 and cap positioning reference area 50A.

6) In the third and fourth embodiments, the cap frame applicable to the cap-frame setting frame 30, 30A may be applied to not only the "non-frame type" of cap frame 60, but also the "frame-type" of cap frame proposed in e.g. the first and the second embodiment (the cap central reference area 20 and cap positioning reference area 20A can be omitted). The operation of holding the cap in the "frame type" of cap frame in its aligned state can be done easily and surely.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A cap frame for holding a cap in order to do embroidery on an area to be embroidered on a front or side of the cap using an embroidery sewing machine, comprising:

a ring-shaped cap frame body to be detachably coupled with a moving mechanism of said embroidery sewing machine;

a cap supporting segment attached to said cap frame body having a curved frame shape, in which said cap is set in a state in which it is put on from the outside;

a holding-down member for holding down the vicinity of the area to be embroidered of said cap onto the cap supporting segment; and a cap central reference area formed at a circumferential center of a front edge on a cap top side of said cap supporting segment, which is tactually recognizable in touch therewith from the outside surface of the cap put on said cap supporting segment, the cap central reference area comprising a recess formed by cutting a part of the front edge on the cap top side of the cap supporting segment.

2. A cap frame according to claim 1, wherein said recess is formed in a V-shape narrowed from the cap top side toward a cap opening side.

3. A cap frame according to claim 1, wherein in putting on or taking off the cap, the cap frame is detachably attached in a cap-frame setting frame in a state in which it is dismantled from said embroidery sewing machine.

4. A cap frame according to claim 1, further comprising a flange supporting body that extends obliquely upward and is attached to the cap frame body, wherein the flange supporting body has an upper surface on which a cap central reference line is marked.

5. A cap-frame setting frame to which a cap frame is detachably attached in putting on or taking off a cap, the cap frame being prepared for holding the cap in order to do embroidery on an area to be embroidered on a front or side of the cap using an embroidery sewing machine, comprising:

a curved base frame fixed onto a predetermined working table, at a predetermined position of which said cap frame is attached; and a cap central reference area formed at a circumferential center of a front edge on a cap top side of said base frame, which is tactually recognizable in touch therewith from the outside surface of the cap put on said cap frame, the cap central reference area comprising a recess formed by cutting a part of the front edge on the cap top side of the base frame.

6. A cap-frame setting frame according to claim 5, wherein said recess is formed in a V-shape narrowed from the cap top side toward a cap opening side.

7. A cap frame for holding a cap in order to do embroidery on an area to be embroidered on a front or side of the cap using an embroidery sewing machine, comprising:

a ring-shaped cap frame body detachably coupled with a moving mechanism of said embroidery sewing machine;

a cap supporting segment attached to said cap frame body having a curved frame shape, in which said cap is set in a state in which it is put on from the outside;

a holding-down member for holding down the vicinity of the area to be embroidered of said cap onto the cap supporting segment; and at least a pair of cap positioning reference areas formed at positions remote from a circumferential center of a front edge on a cap top side of the cap supporting segment toward both sides thereof by predetermined lengths, which are tactually recognizable in touch therewith from the outside surface of the cap put on said cap supporting segment, each of the cap positioning reference areas comprising a recess formed by cutting a part of the front edge on the cap top side of the cap supporting segment.

8. A cap frame according to claim 7, wherein said recess constituting each cap positioning reference area is formed in a V-shape narrowed from the cap top side toward a cap opening side.

9. A cap frame according to claim 7, wherein in putting on or taking off the cap, the cap frame is detachably attached in a cap-frame setting frame in a state in which it is dismantled from said embroidery sewing machine.

10. A cap frame according to claim 7, further comprising a flange supporting body that extends obliquely upward and is attached to the cap frame body, wherein the flange supporting body has an upper surface on which a cap central reference line is marked.

11. A cap-frame setting frame to which a cap frame is detachably attached in putting on or taking off a cap, the cap frame being prepared for holding the cap in order to do embroidery on an area to be embroidered on a front or side of the cap using an embroidery sewing machine, comprising:

a curved base frame fixed onto a predetermined working table, at a predetermined position of which said cap frame is attached; and at least a pair of cap positioning reference areas formed at positions remote from a circumferential center of a front edge on a cap top side of said base frame toward both sides thereof by predetermined lengths, which are tactually recognizable in touch therewith from the outside surface of the cap put on said cap frame, each of the cap positioning reference areas comprising a recess formed by cutting a part of the front edge on the cap top side of the base frame.

12. A cap-frame setting frame according to claim 11, wherein said recess constituting each cap positioning reference area is formed in a V-shape narrowed from the cap top side toward a cap opening side.

* * * * *